United States Patent [19]

Church et al.

[11] Patent Number: 4,982,848

[45] Date of Patent: Jan. 8, 1991

[54] DISPLAY RACK WITH HANGER FIXTURE

[75] Inventors: David F. Church, Kernersville; Michael B. Urbowicz; Joseph W. Honeycut, both of Winston-Salem, all of N.C.

[73] Assignee: Chesapeake Display and Packaging, Winston-Salem, N.C.

[21] Appl. No.: 264,623

[22] Filed: Oct. 31, 1988

[51] Int. Cl.[5] ..... A47F 7/00

[52] U.S. Cl. ..... 211/55; 211/128

[58] Field of Search ..... 211/55, 128, 113, 186; 248/205.3, 225.1, 225.2, 311.2, 223.4

[56] References Cited

U.S. PATENT DOCUMENTS

| | | | |
|---|---|---|---|
| 1,280,955 | 10/1918 | Bowen . | |
| 2,787,433 | 4/1957 | Slavsky et al. . | |
| 2,920,369 | 8/1957 | Zezula . | |
| 2,930,156 | 9/1957 | Jones . | |
| 3,178,138 | 4/1965 | Hessdoerfer et al. | 248/205.3 X |
| 3,248,765 | 5/1966 | Achabal et al. | 248/225.2 X |
| 3,647,078 | 3/1972 | Fortunato . | |
| 3,776,503 | 12/1973 | Boden et al. | 211/113 X |
| 4,444,371 | 4/1984 | Ragen . | |
| 4,472,860 | 9/1984 | Osterlind . | |
| 4,475,660 | 10/1984 | Cain | 211/113 |
| 4,546,943 | 10/1985 | Fast | 248/205.3 |
| 4,671,417 | 6/1987 | O'Brien | 248/220.3 X |

*Primary Examiner*—David M. Purol
*Assistant Examiner*—Sarah A. Lechok
*Attorney, Agent, or Firm*—Bell, Seltzer, Park & Gibson

[57] ABSTRACT

A display rack and an integrally formed hanger fixture for supporting the display rack is disclosed, and wherein the hanger fixture is formed as a L-shaped bracket having substantially horizontal and substantially vertical walls. A retainer wall is connected to a lower portion of the vertical wall and extends upwardly therefrom in substantially parallel spaced relation to the vertical wall to define a gap between the vertical wall and the retainer wall for slidably receiving a rear wall portion of a display rack. A pressure sensitive adhesive is positioned on the underside of the horizontal wall of the hanger fixture for adhesively securing the hanger fixture to a supporting surface.

20 Claims, 1 Drawing Sheet

DISPLAY RACK WITH HANGER FIXTURE

FIELD OF THE INVENTION

This invention relates to a display rack with a hanger fixture for supporting the display rack, and more particularly to an integrally formed hanger fixture for such a rack and which has a substantially horizontal wall for supporting the fixture on a support surface and a substantially vertical wall having connected thereto a parallel retainer wall to define a gap for slidably receiving the backside of a display rack therein.

BACKGROUND OF THE INVENTION

It is common in merchandising to use hanger fixtures or shelf extenders for presenting product literature, containers or other display racks to the purchaser. Customarily, such extenders or hanger fixtures are attached to fixed shelves, price channels, or other supports and receive the literature, containers or display racks thereon. Some of the extenders are small, plastic extruded clips having members which slidably fit into horizontally extending price channels secured onto display shelves or other supports. Price items, advertisements or lightweight displays which would not force the clip away from the price channel are then fitted by plastic connectors, hooks or other means onto the clip for display thereon.

Other shelf extenders and hanger fixtures are supported by a shelf or other supporting surface to give added stability and provide a stronger support for larger, heavier objects and display racks. For example, U.S. Pat. No. 3,647,078 to Fortunato discloses a combination shelf extender and display container having a clamp for securing the extender to the shelf. The extender's frontal plate includes outwardly turned receiving members which cooperate with formed grooves in the back wall of a display container for securing the container wall to the extender. Such clamp extenders will retain larger and heavier objects as compared to the smaller clips prevalent in merchandising. However, the use of clamps is burdensome.

Other similar large extenders and hanger fixtures do not incorporate a clamp. However, many of these extenders and hanger fixtures not having clamps have poor retainability to a shelf or have a structure mandating complex wall designs to ensure proper stability of a supported display rack or container. In addition, complex hanger fixtures are difficult to readily interconnect containers or display racks thereto. Also, many extenders and hanger fixtures extend substantially beyond the shelf upon which they are affixed. Large vertically oriented containers or display racks which are retained thereon often will suspend and swing freely relative to the extender or hanger fixture without adequate support from the shelves or other vertical wall faces adjacent the display rack backside.

It is accordingly an object of this invention to provide a display rack and a hanger fixture for supporting the display rack, and where the hanger fixture is structurally simple and which can be readily secured to a supporting surface.

It is another object of this invention to provide a hanger fixture which can be readily affixed to a paperboard display rack.

It is another object of this invention to provide a hanger fixture for supporting a display rack and which is readily received within a slot formed on the upright rear wall of the display rack.

It is still another object of this invention to provide a hanger fixture for supporting a display rack where movement of the display rack relative to the hanger fixture is minimized.

SUMMARY OF THE INVENTION

These and other objects and advantages of the present invention are accomplished by a hanger fixture for supporting a display rack formed of paperboard. The display rack includes a substantially upright rear wall having at least one relatively narrow horizontal slot formed therein. The hanger fixture is integrally formed and includes an L-shaped bracket having substantially horizontal and substantially vertical walls. The horizontal and vertical walls are substantially rectangularly shaped and formed of relatively thin material.

The hanger fixture further comprises a retainer wall which is formed of relatively thin material and is connected to a lower portion of the vertical wall and extends upwardly therefrom in substantially parallel spaced relation to the vertical wall to define a gap between the vertical wall and the retaining wall. A pressure sensitive adhesive is affixed to the underside of the horizontal wall of the hanger fixture for adhesively securing the same to a supporting surface.

In the preferred embodiment, the hanger fixture includes a lip connected to an upper portion of the retainer wall. The lip extends outwardly a relatively short distance from the retainer wall in a direction away from the vertical wall of the fixture. The lip is dimensioned to be readily received and passed through the slot of the rear wall of the display rack and also to position the gap of the hanger fixture for slidably receiving a rear wall portion of the display rack within the gap to thus interconnect the rack and the hanger fixture.

In a second embodiment, the hanger fixture includes a pressure sensitive adhesive means positioned on the side of the vertical wall juxtaposed to the retainer wall and above the formed gap for adhesively securing the rear wall of a display rack to the vertical wall to aid in preventing sliding movement of a display rack when supported by the hanger fixture. A pressure sensitive adhesive means also is positioned on the backside of the vertical wall opposite the gap to aid in securing the hanger fixture to a vertical face of a supporting surface.

DETAILED DESCRIPTION OF THE PREFERRED EMBODIMENT

Figure 1:
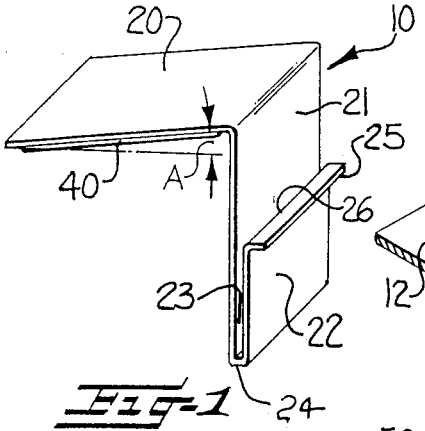
FIG. 1 is an isometric view of the display hanger in accordance with a first embodiment of the invention.
Figure 3:
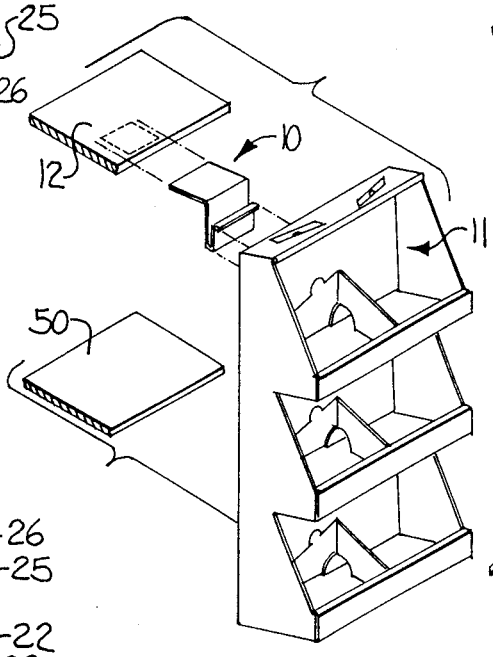
FIG. 3 is another view of the display hanger showing in exploded isometric the positional relationship between the hanger, a display rack and a horizontal shelf.
Figure 4:
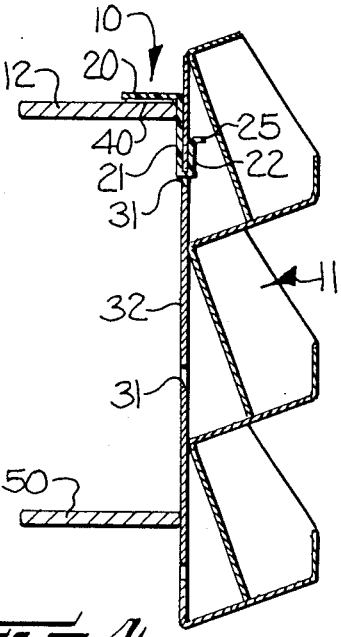
FIG. 4 is a side sectional view of the display hanger connected to a display rack and supported by a shelf.

Referring now to the drawings, and more particularly to FIG. 1, a preferred embodiment of the hanger fixture 10 in accordance with the present invention is shown. The hanger fixture 10 is adapted for interconnection to a display rack 11 for supporting the display rack to a horizontal surface such as a store shelf 12 (FIGS. 3 and 4).

In accordance with the preferred illustrated embodiment shown in FIG. 1, the display hanger 10 is integrally formed from thin, plastic extruded material cut to a predetermined length. The hanger 10 is L-shaped having a substantially horizontal, rectangularly shaped wall 20 connected to a substantially vertical, rectangularly shaped wall 21. In the illustrated preferred embodiment, each wall 20, 21 is approximately 4 inches square and 1/16 inch thick. Both vertical and horizontal walls 20, 21 are connected to form an angle of slightly less than 90° to each other, and as indicated by the angle A in FIG. 1. As will be explained hereafter, when the hanger 10 is supported by a shelf 12 and under load with the display rack 11 connected thereto, the horizontal wall 20 is biased creating a spring like force on the vertical wall 21 forcing the display rack 11 downward against a vertical support or shelf surface.

Figure 5:
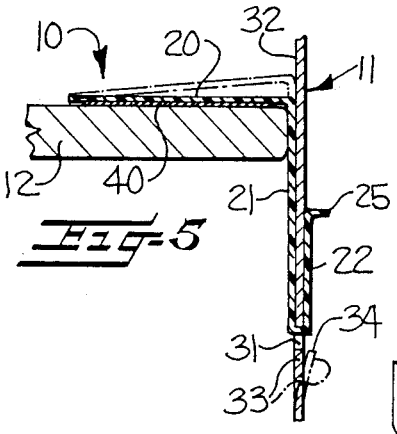
FIG. 5 is an enlarged view of the display hanger of FIG. 4 showing in detail the interconnecting relationship between the display hanger, display rack and shelf.
Figure 6:
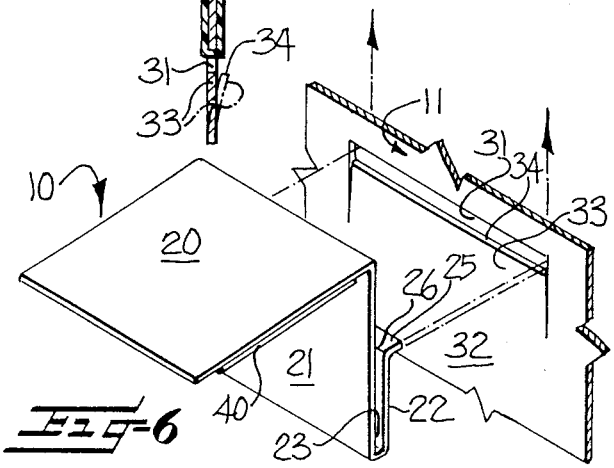
FIG. 6 is an exploded isometric view of the display hanger showing in detail the interconnecting relationship between the display hanger and the flap portion of the display rack.

As illustrated, the hanger 10 includes a rectangularly shaped retainer wall 22 connected to and being integral with the vertical wall 21. The retainer wall 22 has a height of about two inches which in the preferred embodiment is about one half of the height of the vertical wall 21. The retainer wall 22 extends upwardly therefrom in substantially parallel spaced relation to the vertical wall 21 to define a gap 23 between the vertical wall and the retainer wall. A relatively narrow bridging portion 24 (FIG. 2) defines the juncture of the vertical wall 21 with the retainer wall 22. As will be explained in detail later, the lower surface of the bridging portion 24 serves as an abutment stop for engagement with the upper edge of a slot 31 on an upright rear wall 32 of the display rack 11 when the hanger is connected to the display rack (FIGS. 5 and 6).

The hanger fixture 10 also includes a formed lip 25 connected to an upper end of the retainer wall 22. The lip 25 extends outwardly a relatively short distance from the retainer wall 22 in a direction away from the vertical wall 21 of the hanger. In the preferred embodiment, the lip 25 extends outwardly approximately ⅜ inch and the point of connection between the retainer wall 22 and lip defines a curved upper corner surface 26. As will be explained in detail later, the curved upper corner surface 26 facilitates the slidable positioning of the hanger fixture 10 into interconnecting relationship with the display rack 11.

Figure 2:
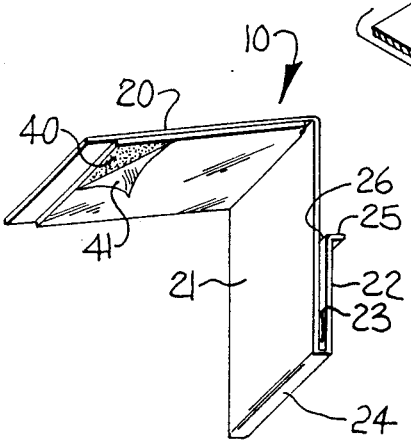
FIG. 2 is a second isometric view of the display hanger showing the pressure sensitive adhesive pad secured on the underside of horizontal wall.

As best seen in FIG. 2, a pressure sensitive adhesive pad 40 is positioned on the underside of the horizontal wall 20 for adhesively securing the hanger fixture 10 to a supporting surface or store shelf 12. The pressure sensitive adhesive pad 40 is formed from a resilient pad having adhesive on both sides. One side of the adhesive pad 40 is adhesively secured to the underside of the horizontal wall 20. The opposite side includes a protective release cover 41 which protects the adhesive to retain its tackiness until the release cover 41 is removed.

Although the hanger 10 can be adapted for use with many varieties of display racks 11, one display rack suitable for use with the preferred embodiment is seen in FIG. 3. The display rack 11 is multishelved and formed of paperboard and as noted above, the display rack includes on its substantially upright rear wall 32 at least one relatively narrow horizontal slot 31 centered on the rear wall 32 of the display rack 11 near its upper edge portion. As illustrated, the slot 31 includes a flap portion 33 having a free upper edge 34 which defines the lower edge of the slot 31. The flap portion 33 makes interconnection between the hanger fixture 10 and display rack 11 easier and is formed by slitting two cut lines downwardly from the upper edge 34.

At the point-of-purchase or other display area, a retailer quickly can interconnect the display hanger 10 to the display rack 11. More particularly, the display hanger lip 25 is initially inserted into the slot 31 located on the rear wall 32 of the display rack 11. As the hanger 10 is pushed against the display rack rear wall 32, the flap portion 33 is pushed inwardly of the slot 31. As the flap portion 33 is moved inwardly, the lip 25 and retainer wall 22 move inwardly to position the gap 23 formed between the vertical and retainer walls 21, 22 under the upper edge of the slot 31. The hanger fixture 10 is then moved upwardly so that the display rack rear wall 32 is slidably received into the gap 23. When the hanger fixture 10 has been fully inserted upwardly onto the rear display rack wall 32, the flap portion 33 returns by reason of its natural bias to its initial position and the lower surface of the display hanger bridging portion 24 serves as an abutment stop for engagement with the free upper edge 34 of the flap portion 33.

When the display hanger 10 has been interconnected with the display rack 11, the release cover 41 is removed from the pressure sensitive adhesive pad 40 secured on the underside of the horizontal wall 20 (FIG. 2). The hanger fixture 10 is then secured to a store shelf 12 or other supporting surface by adhesively securing the fixture to the shelf (FIG. 4). The pressure sensitive adhesive pad 40 acts to prevent lateral movement of the fixture 10 relative to the shelf 12. --Since the hanger fixture 10 is under a load acting through the weight of the display rack 11, the horizontal wall 20 is bent slightly so that a substantially 90° angle is formed between the vertical and horizontal walls 20, 21 (FIG. 5). This bending creates a biasing, spring-like tension which forces the rear wall 32 of the display rack 11 against a shelf 50 or other vertical wall face adjacent the lower portion of the display rack rear wall 32 (FIG. 4). Thus, any additional forces generated by the increased weight of the display rack when objects are inserted therein forces the display rack rear wall 32 against the vertical surface or shelf 50 minimizing the possibility that the hanger display 10 will swing or move laterally relative to the shelves 12, 50.

Removal of the display rack 11 secured in its point-of-purchase area is facilitated by the design of the present invention. With only the pressure sensitive adhesive pad 40 securing the display hanger 10 to a shelf 12, the display rack 11 can be lifted with minimal effort from the shelf 12. Afterwards, the hanger 10 can be disconnected from the display rack 11 by pressing the display rack flap portion 33 inwardly and sliding the hanger downward to disengage the display rack rear wall 32 from the gap 23.

Figure 7:
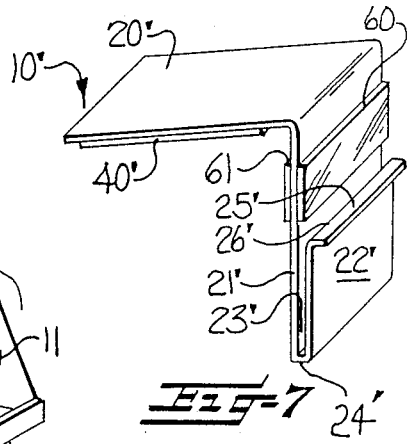
FIG. 7 is an isometric view of the display hanger in accordance with a second embodiment of the invention showing a pressure sensitive adhesive strip secured to the front of the vertical wall.
Figure 8:
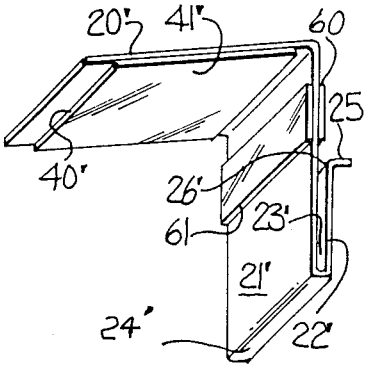
FIG. 8 is an isometric view of the display hanger of FIG. 7 showing a pressure sensitive adhesive strip secured to the backside of the vertical wall.

Referring now to FIGS. 7 and 8, a second embodiment of the present invention is shown at 10', and which includes additional pressure sensitive adhesive strips, preferably of similar construction as the adhesive pad 40' positioned on the underside of the horizontal wall 20', applied to the vertical wall 21, A first strip 60 is positioned on the vertical wall 21, juxtaposed to the retaining wall 22, and above the formed gap 23, The adhesive strip 60 acts to adhesively secure the rear wall of a display rack to the vertical wall 21, to aid in preventing sliding movement of a display rack relative to the hanger fixture 10, The second pressure sensitive adhesive strip 61 is positioned on the rear side of the vertical wall 21' opposite the gap 23, to aid in securing the hanger fixture 10' to a vertical face of a shelf or other supporting surface. Both strips also can include release covers (not shown) to protect the adhesive and retain its tackiness. Although the hanger 10, can interconnect securely a display rack 11 and a shelf or other vertical support surface without the benefit of the additional strips 60, 61, the additional strips provide additional support minimizing the possibility that the display rack 11, will swing or move laterally relative to a shelf.

The foregoing embodiments are to be considered illustrative rather than restrictive of the invention and those modifications which come within the meaning and range of equivalents of the claims are to be included therein.

That which is claimed is:

1. In combination, a display rack formed of paperboard and including a substantially upright rear wall having at least one relatively narrow horizontal slot formed therein, and a hanger fixture for supporting the display rack, said hanger fixture being integrally formed and comprising on L-shaped bracket having substantially horizontal and substantially vertical walls, said horizontal and vertical walls being substantially rectangularly shaped and formed of relatively thin material, a retainer wall formed of relatively thin material and connected to and being integral with the lowermost portion of said vertical wall and extending upwardly therefrom in substantially parallel spaced relation to said vertical wall to define a gap between said vertical wall and said retainer wall, a lip connected to an upper portion of said retainer wall and extending outwardly a relatively short distance from said retainer wall in a direction away from said vertical wall of said bracket, said lip being dimensioned to be readily received and passed through said slot of said rear wall of said display rack, said retainer wall being received through said slot and such that a portion of said rear wall of said display rack is received within said gap to thus interconnect the rack and the hanger fixture, and pressure sensitive adhesive means on the under side of said horizontal wall of said bracket for adhesively securing the same to a supporting surface.

2. The combination according to claim 1 wherein said lip of said hanger fixture is connected to the upper end of said retainer wall and a curved upper corner surface defines the area of connection therebetween, said curved upper surface facilitating the slidable positioning of said hanger fixture into interconnecting relation with said display rack.

3. The combination according to claim 1 wherein said hanger fixture further includes a relatively narrow bridging portion defining the juncture of said vertical wall with said retainer wall, the lower surface of said bridging portion serving as an abutment stop for engagement with an edge of said slot in said back wall of said display rack.

4. The combination according to claim 1 wherein said vertical and horizontal walls of said L-shaped bracket are disposed at an angle of less than 90° to each other when the hanger fixture is not under a load with said display rack.

5. The combination according to claim 1 wherein said retainer wall has a height of about two inches and is about one half of the height of said vertical wall of said hanger fixture.

6. The combination as defined in claim 1 wherein said hanger fixture is integrally formed of plastic.

7. The combination according to claim 1 wherein said pressure sensitive adhesive means includes a resilient pad having adhesive on opposite sides thereof, and wherein a protective release paper covers the adhesive on the outer surface of said pad.

8. The combination according to claim 1 wherein said hanger fixture includes pressure sensitive adhesive means positioned on the side of said vertical wall juxtaposed to said retainer wall and above said formed gap for adhesively securing the rear wall of said display rack to said vertical wall to aid in preventing sliding movement of said display rack relative to said hanger fixture.

9. The combination according to claim 1 wherein said hanger fixture includes pressure sensitive adhesive means positioned on the backside of said vertical wall opposite said gap to aid in securing the hanger fixture to a vertical face of a supporting surface.

10. In combination, a display rack formed of paperboard and including a substantially upright rear wall having at least one horizontal slot formed therein and a flap portion having a free upper edge defining the lower edge of said slot, and a hanger fixture for supporting the display rack, said hanger fixture comprising an integrally formed L-shaped bracket having substantially horizontal and substantially vertical walls, a retainer wall connected to and being integral with the lowermost portion of said vertical wall and extending upwardly therefrom in spaced relation to said vertical wall to define a gap between said vertical wall and said retainer wall, a lip connected to and being integral with an upper portion of said retainer wall and extending outwardly a relatively short distance from said retainer wall in a direction away from said vertical wall of said fixture, said lip being dimensioned to be readily received and passed through said slot on said rear wall of said display rack and to position said gap of the hanger fixture for slidably receiving a rear wall portion of the display rack within said gap to thus interconnect the rack and the hanger fixture, said flap portion of said rear wall of said rack being adapted to be manually biased inwardly of the upper edge of the slot to facilitate interconnecting the display rack and the hanger fixture.

11. The combination according to claim 10 further comprising pressure sensitive adhesive means on the underside of said horizontal wall of said hanger fixture for adhesively securing the same to a support surface.

12. In a structure according to claim 10 wherein said hanger fixture further includes a relatively narrow bridging portion defining the juncture of said vertical wall with said retainer wall, the lower surface of said bridging portion serving as an abutment stop for engagement with said free upper edge of said flap in said rear wall of said display rack.

13. A hanger fixture adapted for supporting a paperboard display rack having a slot formed in a rear wall thereof, said hanger fixture comprising an integrally formed L-shaped bracket having substantially horizontal and substantially vertical walls, said horizontal and vertical walls being substantially rectangularly shaped and formed of relatively thin material, a retainer wall formed of relatively thin material connected to and being integral with the lowermost portion of said vertical wall and extending upwardly therefrom in substantially parallel spaced relation to said vertical wall to define a gap between said vertical wall and said retainer wall, a lip connected to and being integral with an upper portion of said retainer wall and extending outwardly a relatively short distance from an upper portion of said retainer wall and in a direction away from said vertical wall of said fixture for being received in the slot of the display rack, and pressure sensitive adhesive means connected to the underside of said horizontal wall and adapted to be adhesively engaged with a support surface.

14. A hanger fixture according to claim 13 wherein a curved upper corner surface defines the area of connection between the retainer wall on said lip.

15. A hanger fixture according to claim 13 wherein said vertical and horizontal walls of said L-shaped bracket are disposed at an angle of less than 90° to each other when the hanger fixture is not under a load with a display rack.

16. A hanger fixture according to claim 13 wherein said retainer wall has a height of about two inches and is about one-half of the height of said vertical wall of said hanger fixture.

17. A hanger fixture according to claim 13 wherein said pressure sensitive adhesive means includes a resilient pad having adhesive on opposite sides thereof, and wherein a protective release paper covers the adhesive on the outer surface of said pad.

18. A hanger fixture according to claim 13 wherein said hanger fixture includes pressure sensitive adhesive means positioned on the side of said vertical wall juxtaposed to said retainer wall and above said gap for adhesively securing the rear wall of a display rack to said vertical wall to aid in preventing sliding movement of a display rack when interconnected to said hanger fixture.

19. A hanger fixture according to claim 13 wherein said hanger fixture includes pressure sensitive adhesive means positioned on the backside of said vertical wall opposite said gap for securing the hanger fixture to a vertical face of a supporting surface.

20. A hanger fixture according to claim 13 wherein a relatively narrow bridging portion defines the juncture of the vertical wall with the retainer wall, with the lower surface of the bridging portion serving as an abutment stop adapted for engagement with an edge of a slot in said back wall of said display rack.

* * * * *

UNITED STATES PATENT AND TRADEMARK OFFICE

CERTIFICATE OF CORRECTION

PATENT NO. : 4,982,848

DATED : January 8, 1991

INVENTOR(S) : David F. Church, et al,

It is certified that error appears in the above-identified patent and that said Letters Patent is hereby corrected as shown below:

Column 5, line 6, "21," should be -- 21'. --.

Column 5, line 7, "21," should be -- 21' --.

Column 5, line 8, "22," and "23," should be -- 22' -- and -- "23'. --.

Column 5, line 10, "21," should be -- 21' --.

Column 5, line 12, "10," should be -- 10'. --.

Column 5, line 14, "23," should be -- 23' --.

Column 5, line 18, "10," should be -- 10' --.

Column 5, line 23, "11," should be -- 11' --.

Signed and Sealed this

Third Day of August, 1993

*Attest:*

Michael K. Kirk

MICHAEL K. KIRK

*Attesting Officer*

*Acting Commissioner of Patents and Trademarks*